US006923349B2

(12) United States Patent
Lou

(10) Patent No.: US 6,923,349 B2
(45) Date of Patent: Aug. 2, 2005

(54) LOTION BOTTLE STRUCTURE

(75) Inventor: Kun-Lan Lou, Changhua (TW)

(73) Assignee: Jia Hsing Enterprise Co. Ltd., Changhua (TW)

( * ) Notice: Subject to any disclaimer, the term of this patent is extended or adjusted under 35 U.S.C. 154(b) by 237 days.

(21) Appl. No.: 10/458,216

(22) Filed: Jun. 11, 2003

(65) Prior Publication Data

US 2004/0251260 A1 Dec. 16, 2004

(51) Int. Cl.[7] ..... B67D 3/00
(52) U.S. Cl. ..... 222/521; 222/390; 222/189.11
(58) Field of Search ..... 222/519–523, 222/525, 189.06, 189.11, 386, 390

(56) References Cited

U.S. PATENT DOCUMENTS 1,614,077 A * 1/1927 McLaughlin ..... 222/521
2,106,028 A * 1/1938 Heimsch et al. ..... 222/521
4,074,833 A * 2/1978 Otto, Sr. ..... 222/390
4,950,094 A * 8/1990 Yorks ..... 401/75

* cited by examiner

*Primary Examiner*—Michael Mar
*Assistant Examiner*—Patrick Buechner
(74) *Attorney, Agent, or Firm*—Troxell Law Office, PLLC

(57) ABSTRACT

A lotion bottle structure has an outer sleeve tube, an upper control assembly and a lower control assembly adapted at the lower section of the outer sleeve tube therein. The upper control assembly is made up of a sleeve valve and a filter cap. The sleeve valve is adapted to the top opening of the outer sleeve tube and mounted on top of the outer sleeve tube. The lower control assembly is made up of a push part that translates vertically via rotation of the base seat due to the interaction of a threaded column of the push part with a rotary screw sleeve.

7 Claims, 6 Drawing Sheets

LOTION BOTTLE STRUCTURE

BACKGROUND OF THE INVENTION

The present invention is related to an improved lotion bottle structure, comprising an outer sleeve tube, an upper control assembly mounted on top of the outer sleeve tube, and a lower control assembly adapted at the lower section of the outer sleeve tube therein. The upper control assembly is mainly made up of a sleeve valve adapted to the top opening of the outer sleeve tube, a mouthpiece screwed to the outer sleeve tube thereof to abut closely against the sleeve valve thereof, and a filter cap securely mounted on top of the mouthpiece thereof; whereby, lotion adapted at a retaining chamber of the outer sleeve tube can be accurately kept therein without overflowing and messing up the outer side of the mouthpiece and the inner side of the filter cap thereof to maintain good hygiene of the lotion bottle and make good use of the lotion contained therein without wasting thereof.

Please refer to FIGS. 1, 2. A conventional portable lotion bottle 10 is mainly made up a bottle 11, and a cover 12 mounted on top of the bottle 11 thereof. Even when the cover 12 is closed on top of the bottle 11 thereof, lotion A contained at the bottle 11 therein may overflow and mess up the inner side of the cover 12, which can easily generates bacteria therein and is rather untidy in hygiene. In practical use, the bottle 11 is first turned upside down and squeezed in the middle for lotion A to flow out for use as shown in FIG. 2. In case of tremendous squeezing force, lotion A might burst out instantly in great amount, causing a waste of lotion A in use. In case of only small amount of lotion A left and sunk at the bottom of the bottle 11 therein, it takes more waiting time for lotion A to come out. And if squeezed too early, air might burst out along with a minimum of lotion A, which is quite inconvenient in use.

SUMMARY OF THE PRESENT INVENTION

It is, therefore, the primary purpose of the present invention to provide an improved lotion bottle structure, comprising an outer sleeve tube, an upper control assembly mounted on top of the outer sleeve tube, and a lower control assembly adapted at the lower section of the outer sleeve tube therein wherein the upper control assembly has a sleeve valve adapted to the top opening of the outer sleeve tube, a mouthpiece screwed to the outer sleeve tube thereof to abut closely against the sleeve valve thereof and seal up the through holes of the sleeve valve, and a filter cap securely mounted on top of the mouthpiece thereof, whereby, lotion adapted at the outer sleeve tube can be accurately kept therein without overflowing and messing up the outer side of the mouthpiece and the inner side of the filter cap thereof to maintain good hygiene of the lotion bottle and make good use of the lotion without wasting.

It is, therefore, the secondary purpose of the present invention to provide an improved lotion bottle structure wherein the mouthpiece of the upper control assembly is rotated to one side to reveal a gap defined by a tapered abutting facet of the sleeve valve and a tapered abutting nozzle of the mouthpiece thereof for lotion to flow out from the through holes of the sleeve valve thereof for use; whereby, the amount of lotion flowed out for use is regulated via the size of the gap revealed, avoiding the sudden bursting out of lotion due to improper squeezing force and the uneconomical waste of lotion in use.

It is, therefore, the third purpose of the present invention to provide an improved lotion bottle structure wherein the lower control assembly has a push rod with a left-handed threaded column extending at the bottom thereof matching to a right-handed hole of a rotary screw sleeve thereof, whereby, when a base seat mounted at the bottom of the outer sleeve tube is rotated to one side, the rotary screw sleeve will rotate upwards therewith and activate the push rod to move vertically upwards at the outer sleeve tube, pressing lotion adapted therein to go smoothly upwards and flow out via the upper control assembly thereof without interruption in use.

DETAILED DESCRIPTION OF THE PREFERRED EMBODIMENTS

Figure 2:
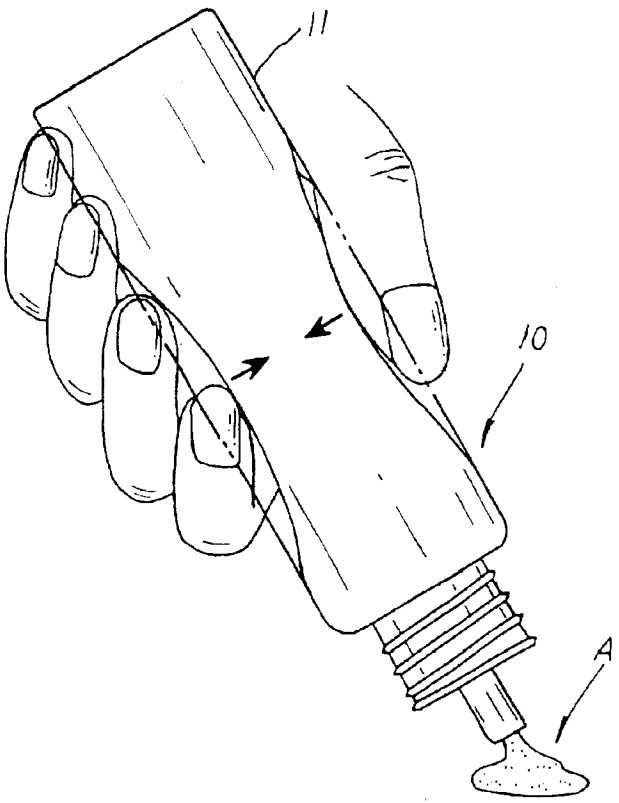
FIG. 2 PRIOR ART
FIG. 2 is a sectional view of a conventional lotion bottle in practical use.
Figure 1:
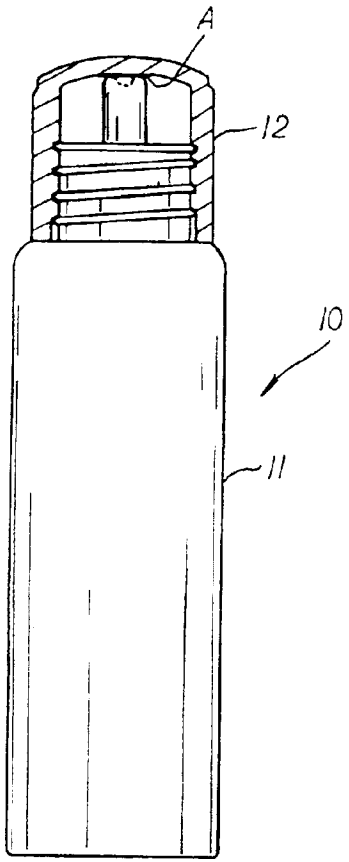
FIG. 1 PRIOR ART
FIG. 1 is a sectional view of a conventional lotion bottle in assembly.
Figure 3:
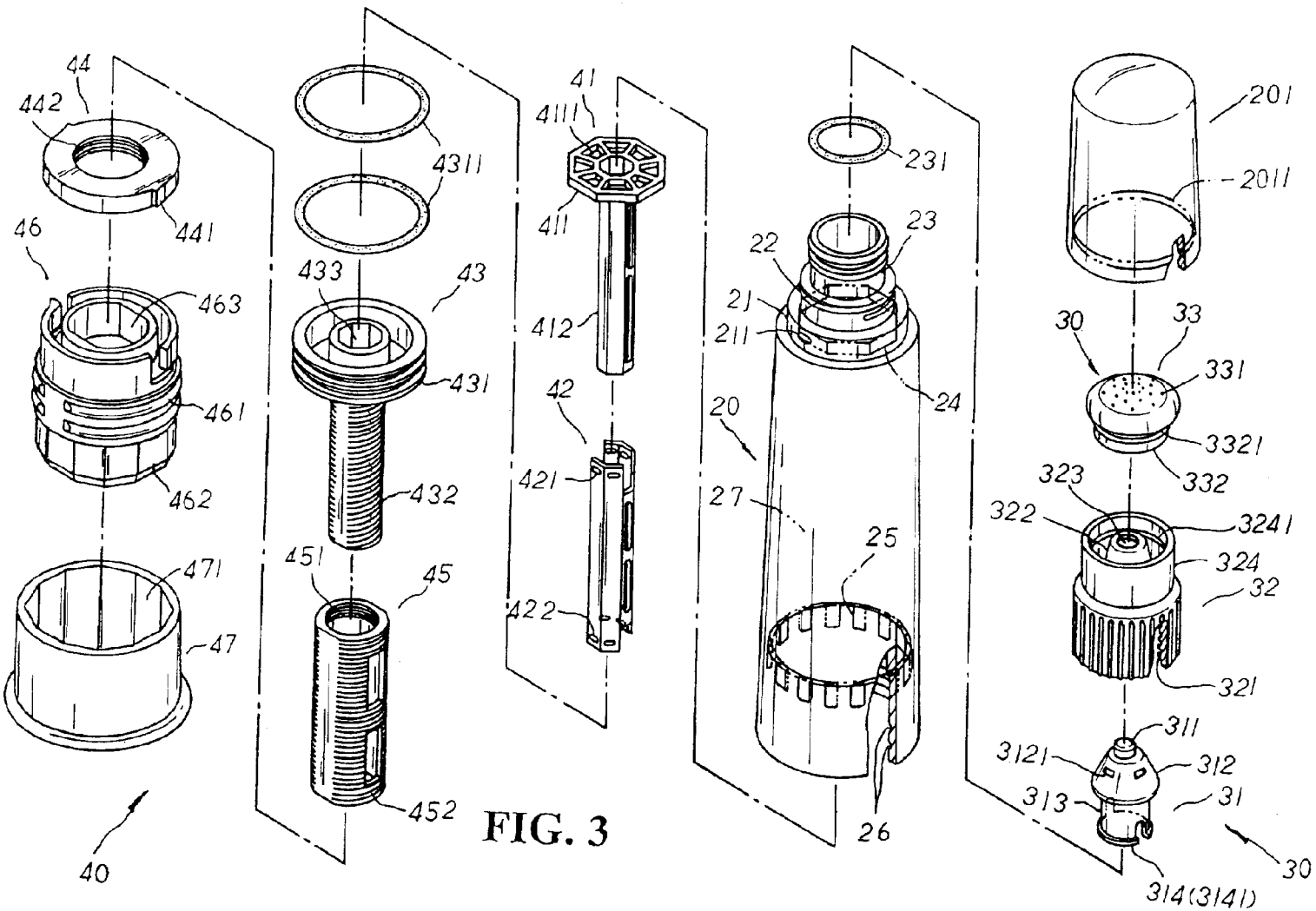
FIG. 3 is a perspective exploded view of the present invention.

Please refer to FIG. 3. The present invention is related to an improved lotion bottle structure, comprising an outer sleeve tube 20, an upper control assembly 30, and a lower control assembly 40. The outer sleeve tube 20, a hollow tubular sleeve, has a small-step coupling ring 21 with engaging dots 211 thereon matching to an internal locating groove 2011 of a cover 201 disposed at the top outer periphery thereof, a step-wise outer threaded section 22 extending on top of the small-step coupling ring 21 thereof, an abutting stop sleeve 23 with a scaling ring 231 adapted thereon projecting on top of the step-wise outer thread section 22 thereof and a polygonal locating section 24 defining the upper inner periphery thereof. The outer sleeve tube 20 also includes a plurality of slant cornered guide blocks 25 distributed at the middle inner periphery thereof, a plurality of ring recesses 26 defining the lower section beneath the guide blocks 25 thereof, and a retaining chamber 27 disposed above the slant cornered guide blocks 25 thereof.

Figure 4:
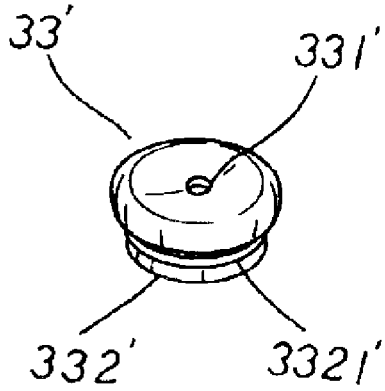
FIG. 4 is another embodiment of the filter cap of upper control assembly of the present invention.

The upper control assembly 30 is made up of a sleeve valve 31, a mouthpiece 32, and a filter cap 33. The sleeve valve 31 has a projecting rod 311 disposed at the top thereof, a tapered abutting facet 312 with through holes 3121 thereon disposed at the middle section thereof, a small-step sleeve part 313 disposed at the lower section thereof, and a pair of symmetrical arc flexible plates 314 with bottom flanges 3141 extending at the bottom of the sleeve part 313 thereof. The mouthpiece 32 is equipped with an internal threaded section 321 defining at the lower section thereof, a tapered abutting nozzle 322 with a central sleeve hole 323 extending at the top thereof, and a coupling section 324 with a coupling groove 3241 thereon circumscribing the tapered abutting nozzle 322 therein. The filter cap 33 (also a filter cap 33' as shown in FIG. 4) has a plurality of filter holes 331 or a central filter hole 331' disposed at the top surface thereof, and a coupling bottom end 332, or 332' with a projecting rib 3321, or 3321' disposed thereon to be engaged with the coupling section 324 of the mouthpiece 32 thereof.

The lower control assembly 40 is made up of a top rod 41, a flexible sleeve 42, a push rod 43, a locating means 44, a rotary screw sleeve 45, an inner locating sleeve 46, and a base seat 47. The top rod 41, a hollow member, has a polygonal fixing part 411 with a plurality of slots 4111 distributed thereon disposed at the top thereof, and a polygonal sleeve post 412 extending downwards at the bottom thereof. The flexible sleeve 42, a polygonal hollow body, is made up of a pair of left and right plates joined via linking plates, each having a pair of upper abutting blocks 421 and lower abutting blocks 422 disposed at both the inner and outer sides thereon respectively (whereby, the top 41 and the flexible sleeve 42 can also be omitted). The push rod 43, closed at the bottom end, has a push part 431 with a plurality of sealing washers 4311 adapted thereto disposed at the top thereof, a left-handed threaded column 432 extending at the bottom thereof, and a polygonal sleeve hole 433 disposed at the center thereof. The locating means 44 has a pair of slant cornered projections 441 symmetrically disposed at the outer periphery thereof, and an inner threaded section 442 disposed at the center thereof. The rotary screw sleeve 45 has a right-handed threaded hole 451 disposed at the center thereof, and outer threaded section 452 disposed at the outer periphery thereof. The inner locating sleeve 46 has a plurality of ring ribs 461 projecting at the middle of the outer periphery thereof, a polygonal engaging section 462 disposed at the bottom thereof, and a central sleeve hole 463 cut with parallel lines at both sides thereof. The base seat 47 is provided with a polygonal engaging groove 471 disposed at the center thereof.

Figure 5:
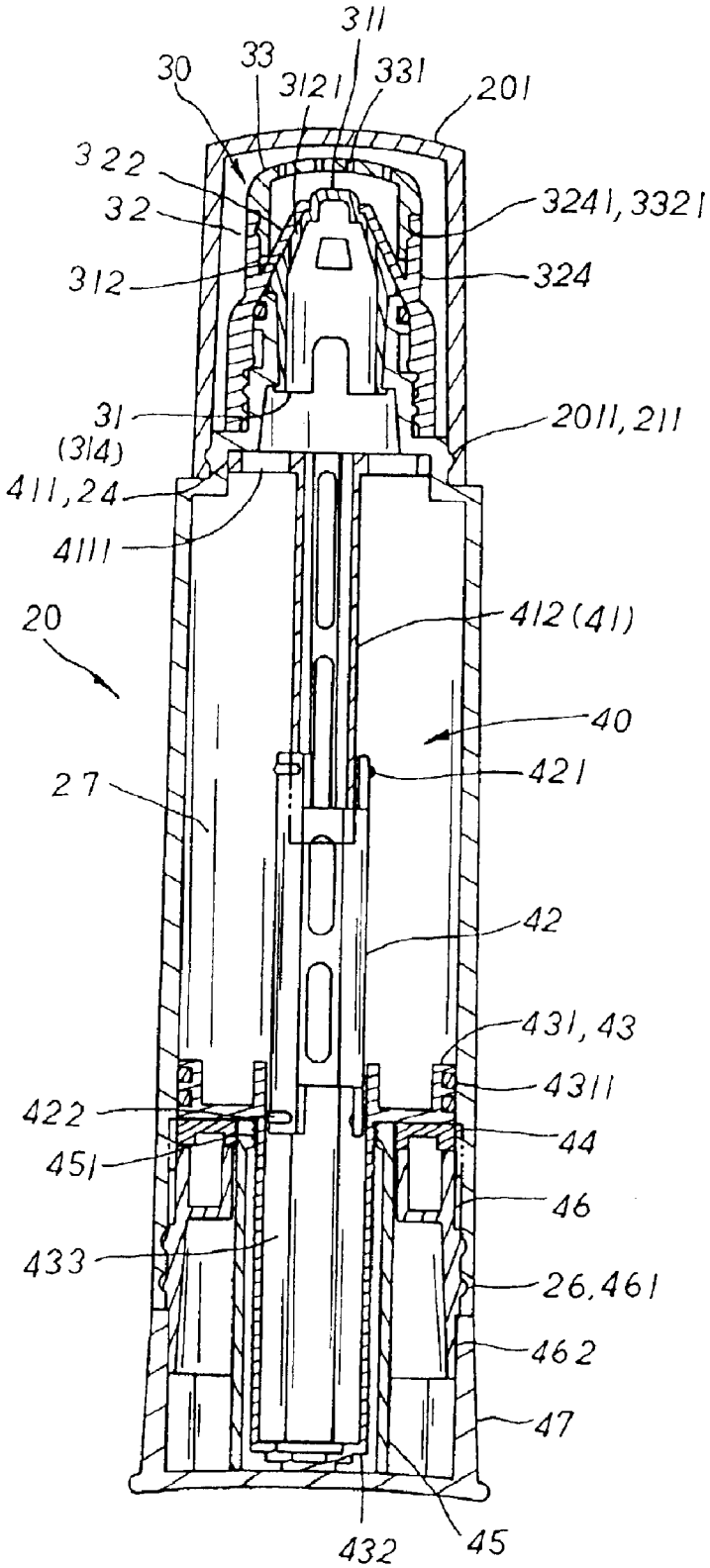
FIG. 5 is a cross sectional view of the present invention in assembly.
Figure 6:
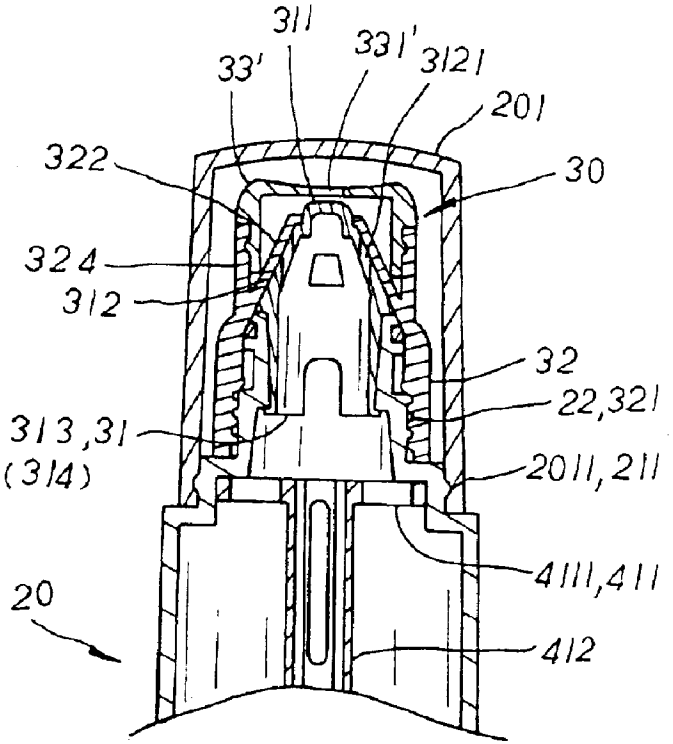
FIG. 6 is a partially sectional view of the present invention in assembly.

Please refer to FIGS. 5, 6. In assembly, the top rod 41 is sleeve joined to the outer sleeve tube 20 with the polygonal fixing part 411 thereof fixedly engaged with the polygonal locating section 24 thereof. The upper section of the flexible sleeve 42 is joined to the bottom of the polygonal sleeve post 412 thereof and flexibly abutted thereto via the upper abutting blocks 421 thereof. The push rod 43 is then led to the flexible sleeve 42 with the polygonal sleeve hole 433 thereof sleeve joined to the lower section of the flexible sleeve 42 and flexibly located thereto via the abutment of the lower abutting blocks 422. The right-handed threaded hole 451 of the rotary screw sleeve 45 is screw joined to the left-handed threaded column 432 of the push rod 43, and the inner threaded section 442 of the fixing means 44 is screwed upwards to the outer threaded section 452 of the rotary screw sleeve 45 till the slant cornered projections 441 of the fixing means 44 correspondingly engaged with the slant cornered guide blocks 25 of the outer sleeve tube 20 and fixed thereto for location thereof. The central sleeve hole 463 of the inner locating sleeve 46 is led through the outer threaded section 452 of the rotary screw sleeve 45 from bottom to top till the ring ribs 461 thereof are engaged with the ring recesses 26 of the outer sleeve tube 20 respectively for location thereof. The polygonal engaging groove 471 of the base seat 47 is then mounted to the polygonal engaging section 462 of the inner locating sleeve 46 thereof and stopped at the bottom of the outer sleeve tube 20 thereof to complete the assembly of the lower control assembly 40 thereof.

After lotion is poured into the retaining chamber 27 of the outer sleeve tube 20, the sleeve valve 31 is adapted to the top opening of the outer sleeve tube 20 with the arc flexible plates 314 thereof sleeve joined therein, the bottom flanges 3141 thereof fixedly stopped at inner side thereof, and the tapered abutting facet 312 located on top of the abutting stop sleeve 23 thereof. The mouthpiece 32 is then mounted on top of the outer sleeve tube 20 with the internal threaded section 321 thereof screw joined to the step-wise outer threaded section 22 thereof till the central sleeve hole 323 thereof engaged with the projecting rod 311 of the sleeve valve 31 and the tapered abutting nozzle 322 thereof closed tightly against the tapered abutting facet 312 of the sleeve valve 31 to seal up the through holes 3121 distributed at the tapered abutting facet 312 thereon. The coupling bottom end 332 of the filter cap 33 or 33' is then mounted to the coupling section 324 of the mouthpiece, and the rib 3321 or 3321' thereof inserted to the coupling groove 3241 thereof for secure location thereof, preventing the lotion from leaking there-into so as to maintain the good hygiene of the filter cap 33 and the mouthpiece 32 thereof to complete the assembly of the upper control assembly 30 as shown in FIG. 6. The cover 201 is finally applied on top of the mouthpiece 32, sleeve joined to the small step coupling ring 21 of the outer sleeve tube 20 with the engaging dots 211 thereof located at the internal locating groove 2011 thereof to complete the assembly of the present invention.

Figure 8:
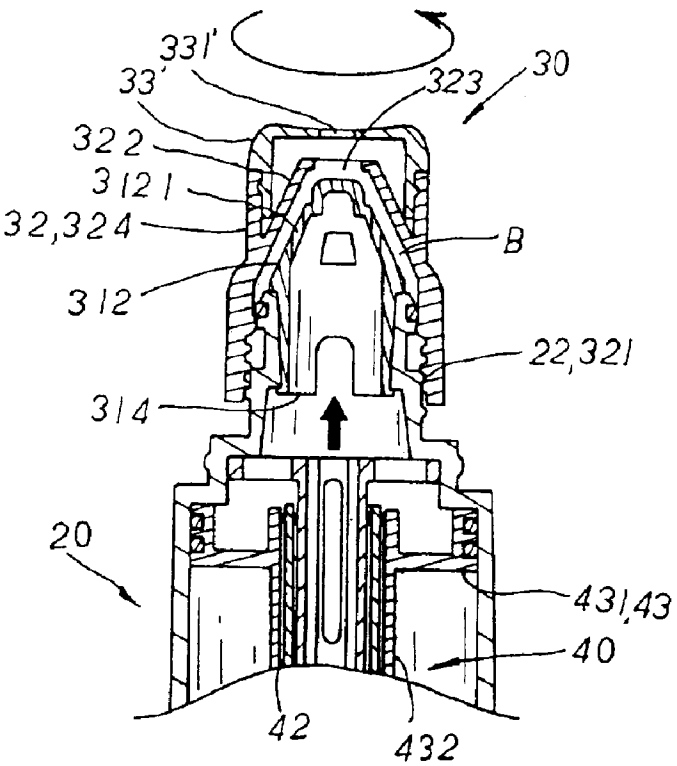
FIG. 8 is a partially sectional view of the present invention in operation.
Figure 7:
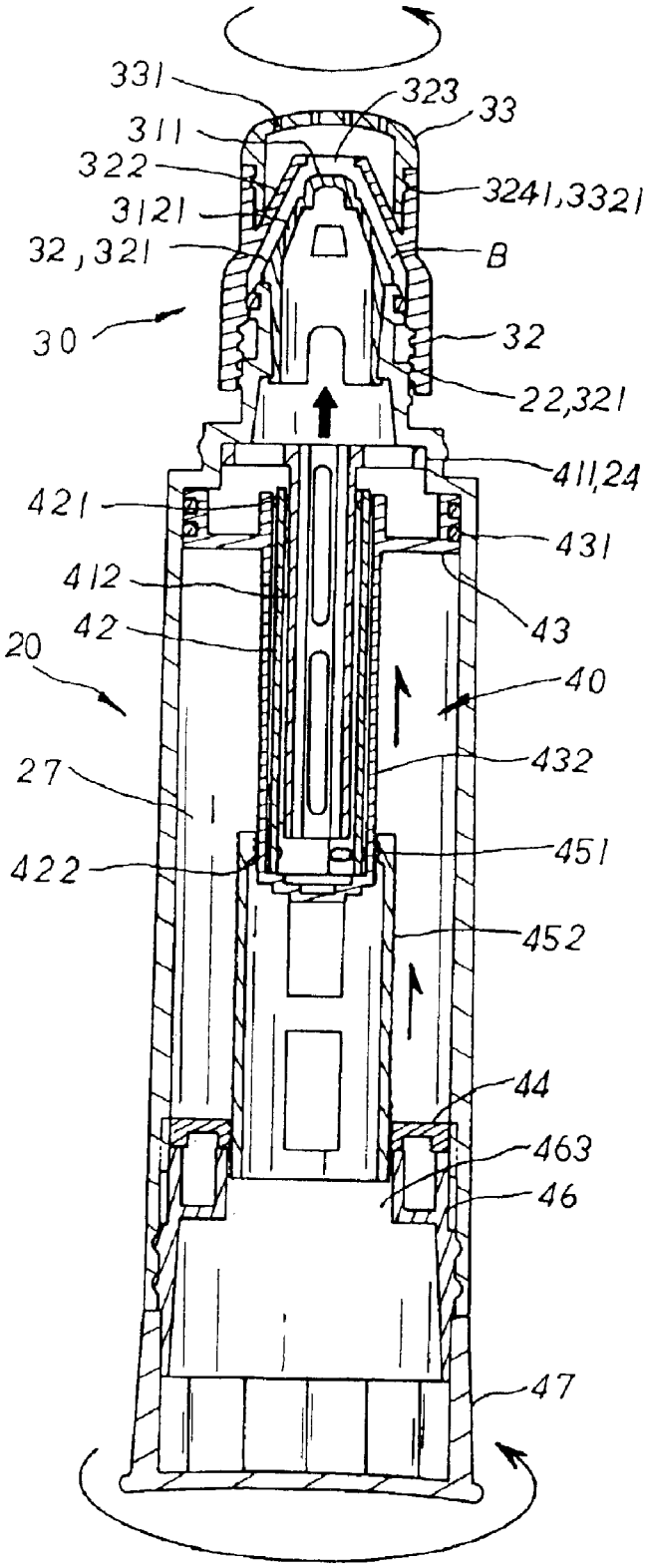
FIG. 7 is a cross sectional view of the present invention in operation.

Please refer to FIGS. 7, 8. In practical use, the cover 201 is first removed from the top of the outer sleeve tube 20. The mouthpiece 32 thereof is then rotated to one side to unscrew the internal threaded section 321 thereof from the step-wise outer threaded section 22 thereof and lift upwards the mouthpiece 32 thereof, detaching the projecting rod 311 of the sleeve valve 31 from the central sleeve hole 323 of the mouthpiece 32 to reveal a gap B defined by the tapered facet 312 of the sleeve valve 31 and the tapered nozzle 322 of the mouthpiece 32 thereof for lotion to come out from the through holes 3121 of the sleeve valve 31 as shown in FIG. 8. The base seat 47 is then rotated to one side, activating the rotary screw sleeve 45 to rotate upwards therewith which, retreating at the same time from the left-handed threaded column 432 of the push rod 43 thereof, will activate the push rod 43 to move vertically upwards at the retaining chamber 27 of the outer sleeve tube 20 thereof. Lotion, adapted at the retaining chamber 27 therein and pressed upwards by the push rod 43 thereof, will go through the slots 4111 of the polygonal fixing part 411 thereof, the through holes 3121 of the tapered facet 312 thereof, the gap B defined by the tapered facet 312 thereof and the tapered nozzle 322 of the mouthpiece 32, and the central sleeve hole 323 of the mouthpiece 32 respectively in a sequence and finally come out through the filter holes 331, or the central filter hole 331' of the filter cap 33, or 33' thereof for use as shown in FIG. 7. Via the adjustment of the gap B formed by the tapered facet 312 and the tapered nozzle 322 thereof, the amount of lotion coming out of the mouthpiece 32 thereof can be easily and accurately regulated without the inconvenience of instant overflowing of lotion to provide a neat and portable lotion bottle for use.

What is claimed is:

1. A lotion bottle structure, comprising an outer sleeve tube, an upper control assembly, and a lower control assembly wherein the upper control assembly is mounted to the upper section of the outer sleeve tube, and the lower control assembly being adapted at the lower section of the outer sleeve tube therein; the present invention being characterized by that, the upper section of the outer sleeve tube, a hollow tubular sleeve, having a small-step coupling ring with engaging dots disposed thereon matching to an internal ring groove of a cover, a step-wise outer threaded section extending on top of the small-step coupling ring thereof, and an abutting stop sleeve with a sealing ring adapted thereon projecting on top of the step-wise outer thread section thereof;

the upper control assembly mounted onto the upper section of the outer sleeve tube being made up of a sleeve valve, a mouthpiece, and a filter cap wherein the sleeve valve, having a projecting rod disposed at the top thereof, a tapered abutting facet with through holes thereon disposed at the middle section thereof, and a small-step sleeve part with a pair of symmetrical arc flexible plates and bottom flanges extending at the lower section thereof, is adapted to the top opening of the outer sleeve tube and sleeve joined thereto with the tapered abutting facet thereof located on top of the abutting stop sleeve thereof; the mouthpiece, having a tapered abutting nozzle with a central sleeve hole disposed at the top thereof, is screwed to the step-wise outer threaded section of the outer sleeve tube via an internal threaded section disposed at the inner bottom side and located thereto on top of the sleeve valve with the central sleeve hole thereof engaging with the projecting rod of the sleeve valve and the tapered abutting nozzle thereof closed tightly against the tapered abutting facet of the sleeve valve to seal up the through holes distributed at the tapered facet thereon;

whereby, when the mouthpiece thereof is rotated to one side to unscrew the internal threaded section thereof from the step-wise outer threaded section thereof and detach the projecting rod of the sleeve valve from the central sleeve hole of the mouthpiece, a gap is formed at the tapered abutting facet of the sleeve valve and the tapered abutting nozzle of the mouthpiece therebetween to reveal the through holes of the sleeve valve thereof for lotion to come out there-through and flow through the central sleeve hole of the mouthpiece to come out via the filter cap mounted on top of the mouthpiece thereof.

2. The lotion bottle structure as claimed in claim 1 wherein the upper inner periphery of the outer sleeve tube is defined by a polygonal locating section thereon.

3. The lotion bottle structure as claimed in claim 1 wherein the abutting facet of the sleeve valve and the abutting nozzle of the mouthpiece thereof are both tapered in shape.

4. The lotion bottle structure as claimed in claim 1 wherein the filter cap of the upper control assembly has a plurality of filter holes disposed at the top surface thereon.

5. The lotion bottle structure as claimed in claim 1 wherein the filter cap of the upper control assembly can also has a central filter hole disposed at the top surface thereon.

6. The lotion bottle structure as claimed in claim 1 wherein the outer sleeve tube also includes a plurality of slant cornered guide blocks arranged at the middle inner periphery thereof with a plurality of ring recesses defining the lower section beneath the guide blocks thereof and a retaining chamber disposed above the guide blocks thereof;

the lower control assembly, adapted at the lower section of the outer sleeve tube thereof, being made up of a top rod, a flexible sleeve, a push rod, a locating means, a rotary screw sleeve, an inner locating sleeve, and a base seat wherein the top rod has a polygonal fixing part with a plurality of slots distributed thereon disposed at the top thereof to be fixedly located to the polygonal locating section of the outer sleeve tube, and a polygonal sleeve post extending downwards at the bottom thereof to be flexibly abutted against upper abutting blocks of the flexible sleeve which, a polygonal hollow body, is in turn flexibly abutted against a central polygonal sleeve hole of the push rod via lower abutting blocks; the push rod, closed at the bottom end, having a push part with a plurality of sealing washers adapted thereto disposed at the top thereof and a left-handed threaded column extending at the bottom thereof to be screw joined to a right-handed hole of the rotary screw sleeve thereof; the locating means having a pair of slant cornered projections symmetrically disposed at the outer periphery thereof to be engaged with the slant cornered guide blocks of the outer sleeve tube for location thereof, and an inner threaded section disposed at the center thereof to be screwed to an outer threaded section of the rotary screw sleeve thereof; the inner locating sleeve having a plurality of ribs projecting at the outer periphery thereof to be engaged with the ring recesses of the outer sleeve tube, a central sleeve hole cut with parallel lines at both sides thereof, and a polygonal engaging section to be mounted onto a polygonal engaging groove disposed at the center of the base seat thereof;

whereby, when the base seat is rotated to one side, the rotary screw sleeve will rotate upwards therewith and activate the push rod to move vertically upwards at the retaining chamber of the outer sleeve tube, pressing the lotion adapted therein to go smoothly upwards to the slots of the polygonal fixing part thereof and flow out via the upper control assembly thereof for use.

7. The lotion bottle structure as claimed in claim 1 wherein the top rod and the flexible sleeve of the lower control assembly can also be omitted with the same effect thereof.

* * * * *